US006842157B2

(12) United States Patent
Phelan et al.

(10) Patent No.: US 6,842,157 B2
(45) Date of Patent: Jan. 11, 2005

(54) ANTENNA ARRAYS FORMED OF SPIRAL SUB-ARRAY LATTICES

(75) Inventors: Harry Richard Phelan, Palm Bay, FL (US); Mark Lawrence Goldstein, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 58 days.

(21) Appl. No.: 10/303,580

(22) Filed: Nov. 25, 2002

(65) Prior Publication Data

US 2003/0076274 A1 Apr. 24, 2003

Related U.S. Application Data

(63) Continuation-in-part of application No. 09/911,350, filed on Jul. 23, 2001, now Pat. No. 6,456,244.

(51) Int. Cl.[7] ..... H01Q 21/00

(52) U.S. Cl. ..... 343/893; 343/844; 343/700 MS

(58) Field of Search ..... 343/893, 895, 343/700 MS, 853, 844, 792.5

(56) References Cited

U.S. PATENT DOCUMENTS

| | | | | |
|---|---|---|---|---|
| 4,052,723 | A | | 10/1977 | Miller |
| 4,465,373 | A | | 8/1984 | Tamaki et al. |
| 5,175,561 | A | | 12/1992 | Goto |
| 5,262,790 | A | | 11/1993 | Russo |
| 5,293,176 | A | | 3/1994 | Elliot |
| 5,327,146 | A | | 7/1994 | Jeon |
| 5,386,215 | A | | 1/1995 | Brown |
| 5,589,728 | A | | 12/1996 | Levine et al. |
| 5,600,342 | A | | 2/1997 | Pikulski et al. |
| 5,711,694 | A | | 1/1998 | Levine et al. |
| 5,808,784 | A | | 9/1998 | Ando et al. |
| 5,815,122 | A | | 9/1998 | Nurnberger et al. |
| 5,838,284 | A | * | 11/1998 | Dougherty ..... 343/893 |
| 5,955,994 | A | | 9/1999 | Staker et al. |
| 6,147,657 | A | | 11/2000 | Hildebrand et al. |
| 6,175,671 | B1 | | 1/2001 | Roberts |
| 6,205,224 | B1 | | 3/2001 | Underbrink |
| 6,211,841 | B1 | | 4/2001 | Smith et al. |
| 6,300,918 | B1 | * | 10/2001 | Riddle et al. ..... 343/895 |
| 6,433,754 | B1 | * | 8/2002 | Boeringer ..... 343/893 |
| 6,522,293 | B2 | | 2/2003 | Vail et al. |
| 6,522,294 | B2 | | 2/2003 | Vail et al. |
| 6,525,697 | B1 | * | 2/2003 | Theobold ..... 343/895 |
| 6,529,166 | B2 | * | 3/2003 | Kanamaluru ..... 343/700 MS |
| 6,583,768 | B1 | * | 6/2003 | Underbrink ..... 343/893 |
| 6,646,621 | B1 | * | 11/2003 | Phelan et al. ..... 343/895 |
| 2003/0142035 | A1 | * | 7/2003 | Goldstein ..... 343/895 |

* cited by examiner

*Primary Examiner*—Tan Ho
(74) *Attorney, Agent, or Firm*—John L. DeAngelis, Jr.; Beusse Brownlee Wolter Mora & Maire, P.A.

(57) ABSTRACT

A antenna array (20) includes a plurality of periodic or aperiodic arranged sub-arrays (22). Each sub-array (22) includes a plurality of antenna elements (32) arranged in the form of a spiral (30). The sub-arrays (22) can comprise various spiral shapes to provide the required physical configuration and operational parameters to the antenna array (20). The elements (32) of each sub-array (22) are arranged to minimize the number of such elements (32) that intersect imaginary planes perpendicular to the spiral and passing through the spiral center. Such an orientation of the elements (32) minimizes grating lobes in the antenna pattern.

41 Claims, 14 Drawing Sheets

ANTENNA ARRAYS FORMED OF SPIRAL SUB-ARRAY LATTICES

CROSS-REFERENCE TO RELATED APPLICATIONS

This patent application is a continuation-in-part of the patent application entitled Phased Array Antenna Using Aperiodic Lattice of Aperiodic Subarray Lattices, filed on Jul. 23, 2001, and assigned application Ser. No. 09/911,350, now U.S. Pat. No. 6,456,244.

FIELD OF THE INVENTION

This invention relates generally to the field of antenna arrays, and more particularly, this invention relates to antenna arrays formed from a single or a plurality of spiral subarray lattices.

BACKGROUND OF THE INVENTION

Typically, the radiation pattern of a single element antenna is relatively wide and the gain (directivity) is relatively low. High gain performance can be achieved by constructing the antenna with a plurality of individual antenna elements in a geometrical and electrical array. These array antennas (or simply arrays) are typically used for applications requiring a narrow beamwidth high-gain pattern (i.e., low energy in the beam side lobes) and the ability to scan over a relatively wide azimuth region. Low side-lobe antennas are especially advantageous for satellite communications and scanning radars.

The individual antenna elements in the array are usually identical, although this is not necessarily required, and may comprise any antenna type, e.g., a wire antenna, dipole, patch or a horn aperture. The spacing of the elements is typically periodic. The composite radiation pattern of an array antenna array is determined by the vector addition of the electric and magnetic fields radiated by the individual elements. To provide a directive array antenna radiation pattern, the elemental fields add constructively in the desired direction and add destructively in those directions where no signal is desired. Also, the array antenna can be scanned over an angular arc by simply controlling the phase and/or amplitude of the signal input to each element. By contrast, scanning a parabolic dish antenna requires drive motors to physically move the dish through the desired scan angle.

Assuming the array antenna comprises identical antenna elements, there are five conventional array parameters that can be varied to achieve the desired antenna performance: the geometrical shape or configuration of the array antenna (e.g., linear, circular, rectangular, spherical), the relative displacement between the array elements, the excitation signal amplitude and phase that drives the elements and the radiation pattern of the individual elements.

Array antennas can be constructed in many different geometrical shapes. The most elementary shape is a simple linear array where the antenna elements lie along a straight line. A planar array is bounded by a closed curve; circular and rectangular are the most common planar array shapes. In a conformal array the elements and the substrate to which they are attached are made to conform to the surface of a structure, such as the skin of an aircraft.

However, array antennas are not without disadvantages. Each element is fed by a complex feed network of electronic components, but close element spacing (typically a half wavelength) requires a small pitch feed network. Squeezing the feed network into the small space between the elements presents difficult design and manufacturing challenges, resulting in an expensive feed network, and expensive, miniaturized element-level electronics (often referred to as element modules). The spacing problem is exacerbated at shorter operational wavelengths, i.e., at higher frequencies. Bandwidth limitations and mutual coupling between closely-spaced elements and their feeds also present disadvantages. It is also difficult to provide dual or multi-beam operation within an array antenna due to these various antenna element spacing issues.

In addition to forming an array antenna from individual elements, the antenna can be formed from a plurality of individual sub-arrays (also referred to as sub-array lattices or sub-array grids), where each sub-array further comprises a plurality of individual antenna elements arranged in a geometrical pattern. The individual sub-arrays are tessellated to form the array antenna. Four different sub-array grid configurations are commonly used and described below.

The periodic sub-array lattice comprises a plurality of equally-spaced elements arranged in the form of a polygon, such as a rectangle or an equilateral triangle. The triangle offers a higher packing density for the array antenna, as the sub-array triangles can be oriented to form a honeycomb pattern, and the effective per-element spacing is smaller. The element periodicity (i.e., the distance between individual elements of the sub-array) is established to produce the desired antenna operational characteristics, but as discussed above, closely-spaced elements require a closely-spaced and expensive feed network and array electronics.

The total scan angle and usable bandwidth for the periodic sub-array are limited by the presence of grating lobes in the radiation pattern. These grating lobes, which are major lobes in the radiation pattern with an intensity about equal to the main lobe, are especially prevalent at higher frequencies, such as X-band and Ku-band frequencies. Operation at lower frequency, such as UHF, L-band and S-band, have also been found to produce grating lobes in certain antenna arrays. Notwithstanding the grating lobes, the periodic array has a relatively high array efficiency as the antenna elements are efficiently dispersed through out the entire array antenna aperture.

A random sub-array, where the sub-array elements are randomly spaced with respect to each other, can reduce the grating lobes in the radiation pattern of the array antenna. The sub-array element spacing can be constrained so as not to exceed a given value (for example, a half-wavelength) or can be unconstrained. However, optimal element spacing for the random sub-array has not been determined and is not amenable to a closed form solution. Also, if the average spacing is permitted to exceed about a half wavelength at the operating frequency, performance of the array antenna is severely degraded. To form the array antenna, the random sub-arrays can be randomly positioned or the sub-arrays can be arranged in the shape of a polygon.

Any periodic sub-array can be thinned, i.e., elements randomly removed to reduce the side lobe energy, and to a lesser extent, the grating lobe effects. However, the thinning process has not been optimized nor quantified to produce predictable radiation patterns. As a result, considerable design effort is required for each specific application in which the thinning process is employed.

A plurality of ring sub-arrays (i.e., a series of concentric rings) can be used to form a main array antenna by spacing the sub-arrays either periodically or aperiodically. Also, the number of elements in each ring sub-array can be varied. For example, in addition to a central element, an inner sub-array ring can include 7 elements, surrounded by a second ring comprising 13 elements and further surrounded by a third ring comprising 19 elements. It has been determined that the ring is near optimal for grating lobe suppression when the number of elements in each sub-array ring is a prime number. Although an array antenna formed of ring sub-arrays reduces the grating lobes, there is no closed form solution for constructing the array. Like the random and thinned sub-arrays, each design application must be optimized by trial and error. Such an antenna array is disclosed and claimed in the commonly owned patent entitled, "Phased Array Antenna Using Aperiodic Lattice Formed of Aperiodic Subarray Lattices," bearing issued U.S. Pat. No. 6,456,244, which is incorporated herein by reference and from which the present application is a continuation-on-part.

A high gain array antenna with wide angular coverage, is typically comprised of a plurality of panels, where each panel further comprises a plurality of sub-arrays. Each panel provides radiation coverage over a different spatial sector. For example, panels of sub-arrays can be configured on a pyramidal structure for providing hemispherical coverage.

BRIEF SUMMARY OF THE INVENTION

The present invention advantageously teaches an array antenna comprising a plurality of sub-arrays, wherein the antenna elements of each sub-array are arranged in an aperiodic spiral configuration. In one embodiment the spiral configuration can be Archimedean, logarithmic, or another configuration where the boundaries of the sub-array approximate a circle. In other embodiments, to support the optimal geometric combination of the sub-arrays, sub-arrays based on a square, octagon or polygon can be used. The special case represented by a single sub-array is further included within the scope of the present invention. These shapes further allow the formation of array configurations that are three-dimensional and offer desired spatial coverage characteristics. Foe example, a pyramidal array configuration can be constructed with four polygonal sides and a square top. A cubic array can be constructed with four square sides and a square top. Other three-dimensional arrays can be constructed based on various polygonal shapes.

In one embodiment the spacing of the sub-array elements is established by minimizing the number of elements intersected by vertically perpendicular planes passing through the spiral center. With the sub-array elements arranged in this manner, the radiation pattern side lobes are reduced, especially the grating lobes. Also, this characteristic provides a wider antenna bandwidth and allows much larger spacing of the elements as compared with the periodically spaced arrays of the prior art. The element spacing can be increased from a half-wavelength to one wavelength, or more, allowing for a four-to-one increase in the element spacing. Using this technique, arrays have been constructed operating with a 300% bandwidth. The individual sub-arrays can be periodically or aperiodically tessellated to form the array antenna.

BRIEF DESCRIPTION OF THE DRAWINGS

The foregoing and other features of the invention will be apparent from the following more particular description of the invention, as illustrated in the accompanying drawings, in which like reference characters refer to the same parts throughout the different Figures. The drawings are not necessarily to scale, emphasis instead being placed upon illustrating the principles of the invention.

DETAILED DESCRIPTION OF THE INVENTION

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

Figure 1:
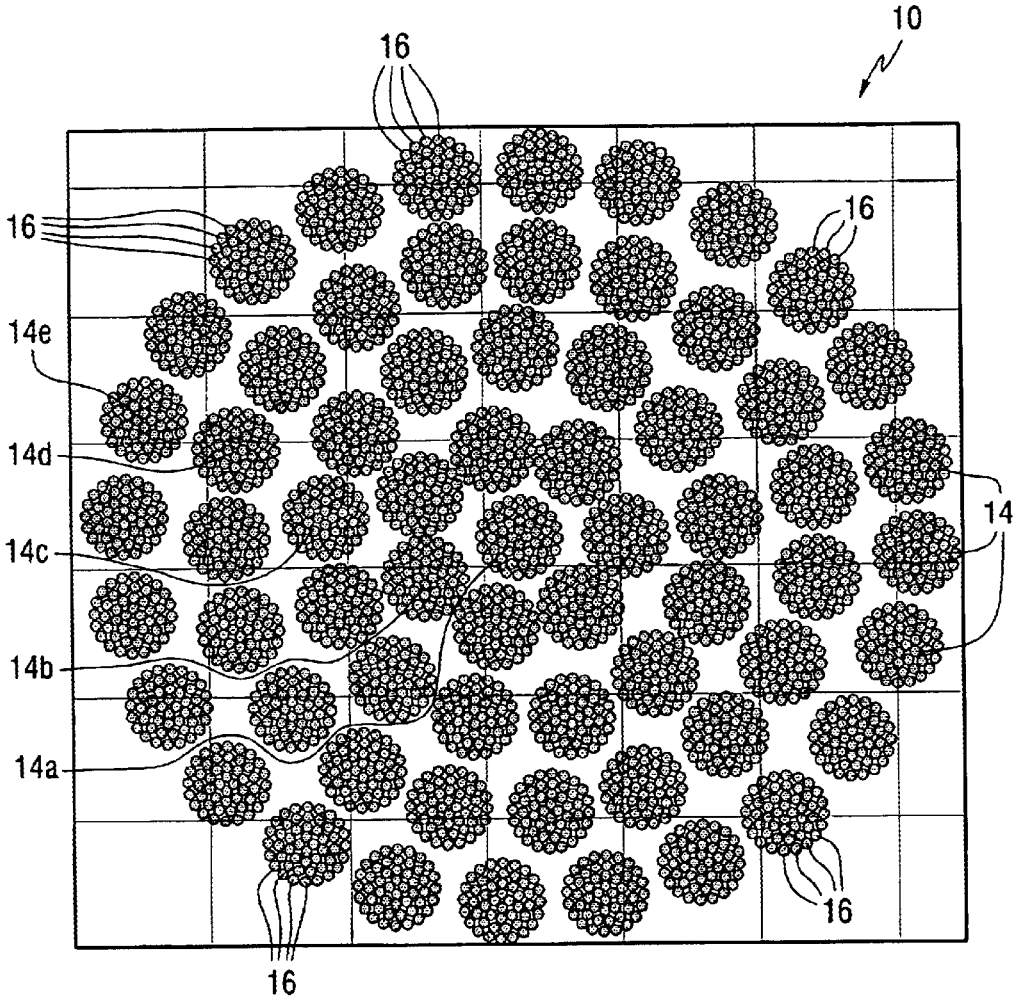
FIG. 1 illustrates an aperiodic array antenna comprising aperiodic ring sub-arrays.

FIG. 1 illustrates an array antenna 10 of the co-pending, commonly-owned patent application, comprising a plurality of preferably identical aperiodic sub-arrays 14, where antenna elements 16 of each aperiodic sub-array 14 are configured in concentric circles as shown. The sub-arrays 14 are then aperiodically arranged to form the array antenna 10. The array antenna 10 can be a two or three dimensional structure, for example a polygon, a cube, other polygonal three-dimensional shapes, or a conformal structure.

The exemplary embodiment of the array antenna 10 comprises a center aperiodic sub-array 14*a*, surrounded by a ring 14*b* of sub-arrays 14. In the embodiment of FIG. 1, the ring 14*b* comprises seven sub-arrays 14. The ring 14*b* is surrounded by three additional concentric rings 14*c*, 14*d* and 14*e*, also oriented in an aperiodic configuration. In one embodiment, the ring 14*c* includes 13 sub-arrays 14 and the ring 14*d* includes 19 sub-arrays 14. The ring 14*e* includes 24 sub-arrays 14, for a total of 64 sub-arrays constituting the array antenna 10. It has been found that the array antenna 10 formed from an aperiodic arrangement of the aperiodic sub-arrays 14 reduces grating lobe effects, provides wide bandwidth operation and greater element spacing.

The antenna array of the present invention also comprises a plurality of sub-arrays, but herein the sub-array elements are preferably arranged in a spiral shape, that is, the elements of a sub-array are arranged on a spiral grid. Advantageously, it has been determined that if imaginary vertical planes passing perpendicularly through the center of the spiral sub-array intersect a minimum number of sub-array elements, then the grating lobes are reduced. The fewer element intersections for each said plane, the greater the reduction in the grating lobes. An array antenna of the present invention comprises a plurality of such spiral sub-arrays spaced periodically or aperiodically with respect to the other sub-arrays of the array.

As will be described further below, the sub-arrays can take any of various spiral shapes, including an Archimedean, log or variable angle spiral. Any spiral shape where the distance between successive turns of the spiral increases, decreases or remains constant, can be used as a grid pattern for the placement of the elements of the sub-array. The array antenna formed with these spiral sub-arrays has reduced amplitude or nearly non-existent grating lobes and a wide operational bandwidth. It has been determined that the side lobe energy emitted from an antenna using the spiral sub-arrays according to the teachings of the present invention is approximately equivalent to that emitted with the random aperiodic sub-arrays of the commonly-owned patent application discussed above. But the spiral sub-arrays of the present invention are much easier and less expensive to design and manufacture, as the element grids have a known pattern, i.e., a spiral. Each sub-array can further include a single balanced or single unbalanced spiral, or a plurality of spirals, such as dual spirals (two nested spirals) or quad spirals (four nested spirals). Multiple spirals within one sub-array allow multiple beam operation at different frequencies or multiple beam operation at the same frequency. Furthermore, the spiral sub-array can be formed within the boundaries of a geometrical shape that can then be efficiently tessellated to conform to the shape of the overall array antenna. Three-dimensional array antennas can be formed by stacking a plurality of sub-arrays constructed according to the teachings of the present invention.

Within each sub-array, the element spacing and size can be varied (scaled up or down) as required to satisfy the design parameters of the array antenna (e.g., bandwidth, center frequency), so long as the intersections of elements with the imaginary perpendicular plane as described above are minimized, thereby minimizing the grating lobes. Further, the feed network, aperture taper, and element type (e.g., wire, horn, patch) can be selected to achieve the desired impedance matching, scan gain coverage, side lobes and other desired performance characteristics.

Aperture taper is the variation of excitation amplitude across the aperture of the array antenna. For example, for a circular array antenna and uniform element excitation, the first beam side lobes drop to about 17.6 dB and if the amplitude is tapered by 10 dB, the first side lobes drop to about 23 dB. Aperture taper can be achieved by inserting static reduction of power, exciting a given element via the interaction between the element feed network and the element.

The scan coverage of an array antenna is determined by the active element pattern of the elements in the array environment. The relatively large element spacing provided by the antenna of the present invention tends to reduce element mutual coupling and thus produces smooth and well-controlled element patterns with minimized scan losses for the array antenna.

Within each sub-array the element cell, or simply cell, defines the area allocated to each element in the sub-array. For example, for a square grid with element spacing "x," the element cell is $x^2$. According to the teachings of the present invention, the element cell can be constant or can change according to a pattern along the spiral path. For example, the element cell can increase from the center of the spiral to the end of the spiral. In an Archimedean spiral the element cell is essentially constant along the spiral when the element spacing along the spiral is maintained constant. In a variable rate log spiral, larger elements can be used near the center of the spiral and smaller elements near the end of the spiral, or vice versa. These embodiments where the element cell or element spacing varies along the spiral path are also referred to as tapered element grids. Increasing the element spacing from the spiral center produces aperture tapering that can further reduce the side lobe levels. Spirals incorporating tapered or constant spacing can be used in the spiral arrays of the present invention.

Generally, as compared to the prior art array antennas, the antenna arrays constructed according to the present invention include fewer antenna elements and larger sub-arrays for easier integration into a less complex array antenna. Aperture tapering can be accomplished by the judicious selection of the sub-array grid configuration and element thinning techniques, which provides a greater separation between adjacent elements. The technique developed for positioning the sub-array elements according to the present invention provides a faster design cycle than prior art arrays, resulting in reductions in development cost and complexity. The array antennas constructed according to the teachings of the present invention can be used in any phased array application, as well as cellular base stations and microwave line-of-sight installations.

Figure 2:
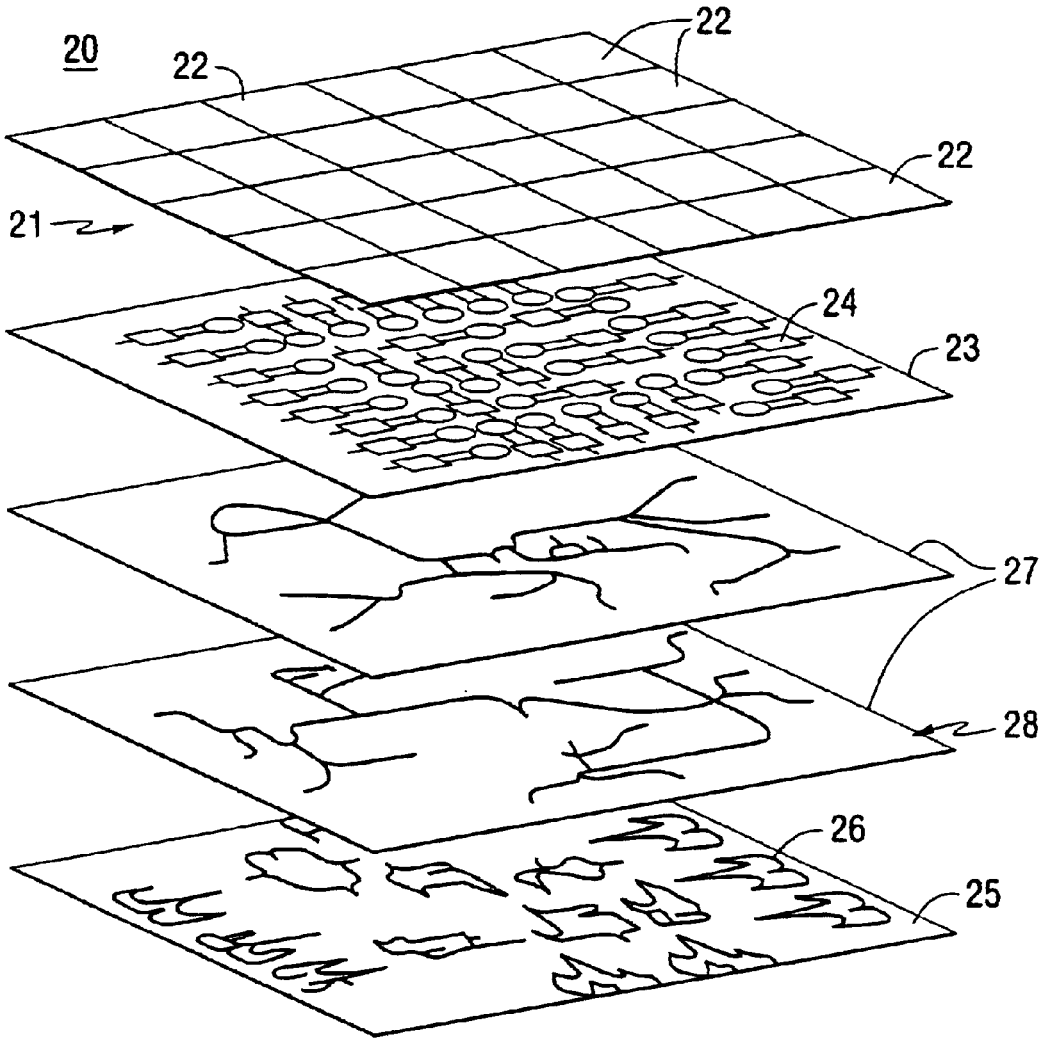
FIG. 2 is an exploded view of an array antenna, including the underlying support layers.

As illustrated in FIG. 2, an exemplary array antenna 20 includes a plurality of vertically oriented layers, including an antenna element layer 21 comprising a plurality of element sub-arrays 22 to be discussed further below. According to one aspect of the teachings of the present invention, each of the sub-arrays 22 comprises a spiral arrangement of antenna elements. A layer 23 can include, for example, amplifier elements 24, including low noise amplifiers and their associated components. A layer 25 can include, for example, phase shifters and post amplification circuit elements, including power combiners and beam steering elements that are represented generally by a reference character 26. Intermediate layers 27 (shown as two exemplary layers in FIG. 2) can also include beam former, power combining and signal distribution elements, represented generally by a reference character 28. Any one or more of the various layers illustrated in FIG. 2 can include beam control components, filtering networks, power supplies, cooling circuitry and other components as required for an operational array antenna. The array antenna 20 can be placed within a support structure or radome (not shown) as dictated by the specific application.

Advantageously, an array antenna constructed according to the teachings of the present invention can be formed on a low cost circuit board, in lieu of manufacturing individual element modules. The antenna elements can be printed radiating elements formed from conductive traces on the circuit board or can be in the form of surface mounted components. These attributes of the present invention allow for less expensive design and manufacturing of antenna arrays.

Figure 3:
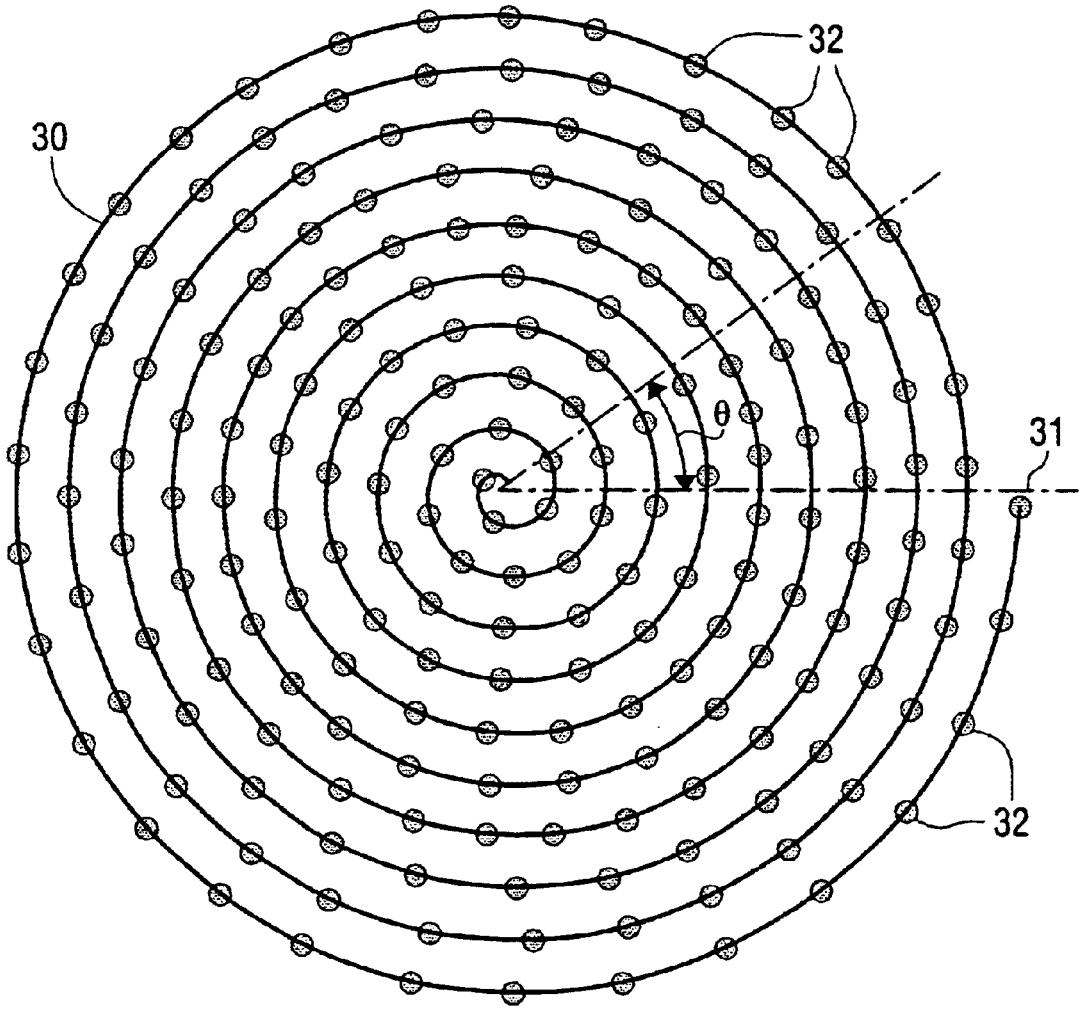
FIGS. 3 through 10 illustrate various embodiments of spiral sub-arrays according to the teachings of the present invention.

An Archimedean spiral 30 comprising a plurality of elements 32 is illustrated in FIG. 3. Each of the sub-arrays 22 of the array antenna 20, in one embodiment of the present invention includes a plurality of antenna elements arranged along the legs of the Archimedean spiral 30 as illustrated in FIG. 3. An Archimedean spiral is defined by the polar coordinate equation:

$$r=a\theta^N \tag{1}$$

where r is a radius or distance from the spiral center, θ is an angle measured from a baseline 31 illustrated in FIG. 3 and "a" and N are selected parametric values. The shape of the Archimedean spiral is determined by the selection of a value for N, which determines the rate at which the spiral increases as θ is increased from 0 through 360 degrees. For the Archimedean spiral 30 illustrated in FIG. 3, N=1. This is a special case of the Archimedean spiral referred to as the Archimedes spiral. The parametric value "a" determines the distance between successive spiral loops at a given angle. Thus a large value for "a" establishes a relatively large distance between successive spiral loops at a given angle. A small value for "a" forms a tightly wound Archimedean spiral.

The plurality of elements 32 can be equally or unequally spaced along the arc of the Archimedean spiral 30. It has been determined according to the present invention that minimizing the number of elements intersecting the imaginary planes perpendicular to the sub-array plane and passing through the spiral center reduces grating lobe effects. If elements appear in such a plane, then at some angle other than the desired scan angle the radiation adds constructively, creating a grating lobe. Minimizing the number of elements in these planes thus reduces the grating lobes. In the various embodiments of the present invention, the various selectable antenna parameters, the feed network excitation, aperture taper, element size or grid (scaled up or down), element spacing and type (e.g., wire, dipole, patch or horn) are chosen to achieve the desired array antenna characteristics, including impedance matching, scan gain coverage, side lobes and other desired performance characteristics, so long as the intersections of elements with the imaginary perpendicular plane are minimized to minimize the grating lobes.

Generally, the number of elements in a sub-array, such as the sub-array 22 above, is selected to provide the desired performance parameters while offering manufacturability efficiencies. Typically, the element numbers are in the range of 16 to 64, although this is not a fixed range.

Figure 4:
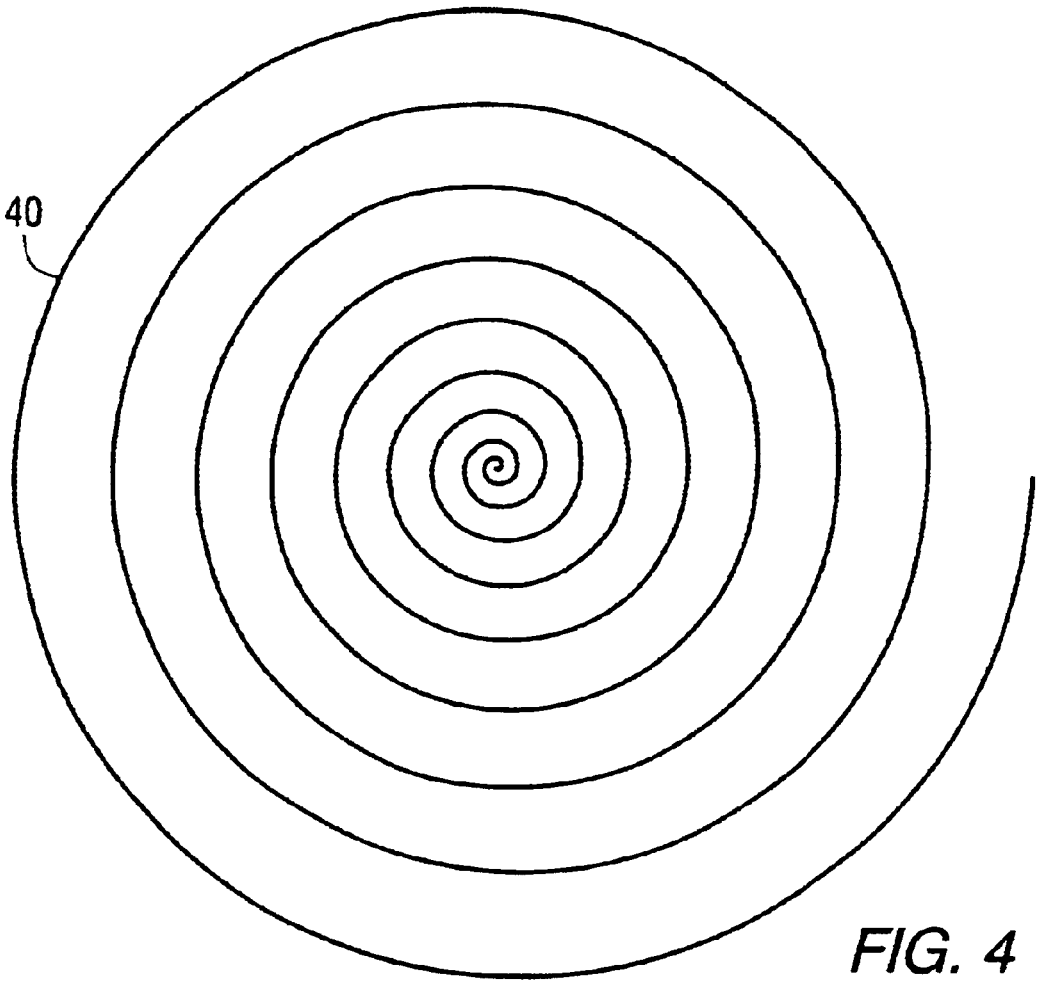

FIG. 4 illustrates a log spiral 40 defined by the following equation:

$$\rho=\rho_0\exp(\phi/\tan\gamma) \tag{2}$$

where $\rho$ and $\phi$ are the radius and polar angle, respectively, of any point on the log spiral 40. $\gamma$ a selected spiral angle value and $\rho_0$ is the initial radius corresponding to $\phi=0$. As in the case of the Archimedean spiral 30 above, the individual sub-array elements can be equally or unequally spaced along the arc length of the log spiral 40 and can be scaled up or down in size. The various known antenna types can be used as the elements. However, minimizing the number of elements intersecting the imaginary perpendicular planes reduces grating lobe effects.

Figure 5:
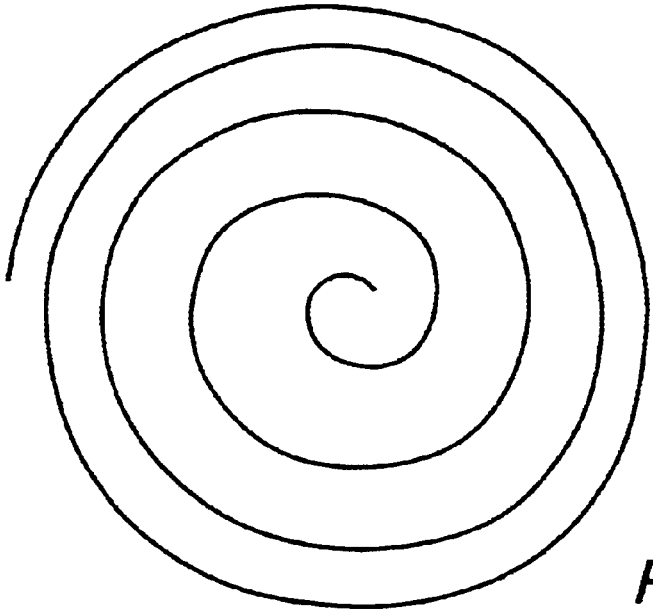
Figure 6:
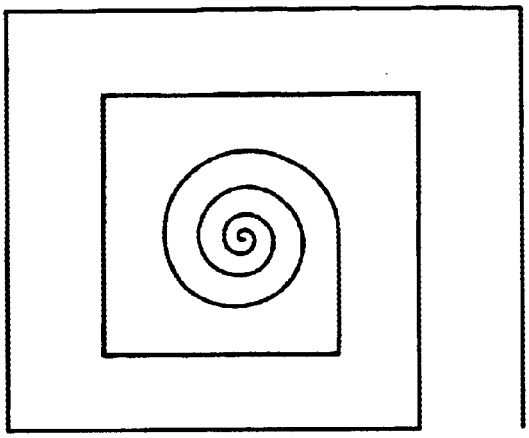

FIG. 5 illustrates a reverse log spiral 44 where the distance between adjacent arms decreases from the center in a logarithmic relationship. FIG. 6 illustrates a spiral in which the arms transition from a first curve shape to a second curve shape along the path from the center of the spiral. The curve shapes shown are merely exemplary, although this embodiment illustrates the ability of sub-arrays of the present invention to fill an available square space and maximize aperture utilization efficiency. As discussed above in conjunction with the other spiral shapes, the element spacing and size can be varied (scaled up or down) as required to satisfy the design parameters of the antenna array, so long as the intersections of elements with the imaginary perpendicular plane as described above are minimized. Also, as is known to those skilled in the art, various antenna types can be used as the elements in the FIGS. 5 and 6 embodiments to achieve the desired performance parameters.

Figure 7:
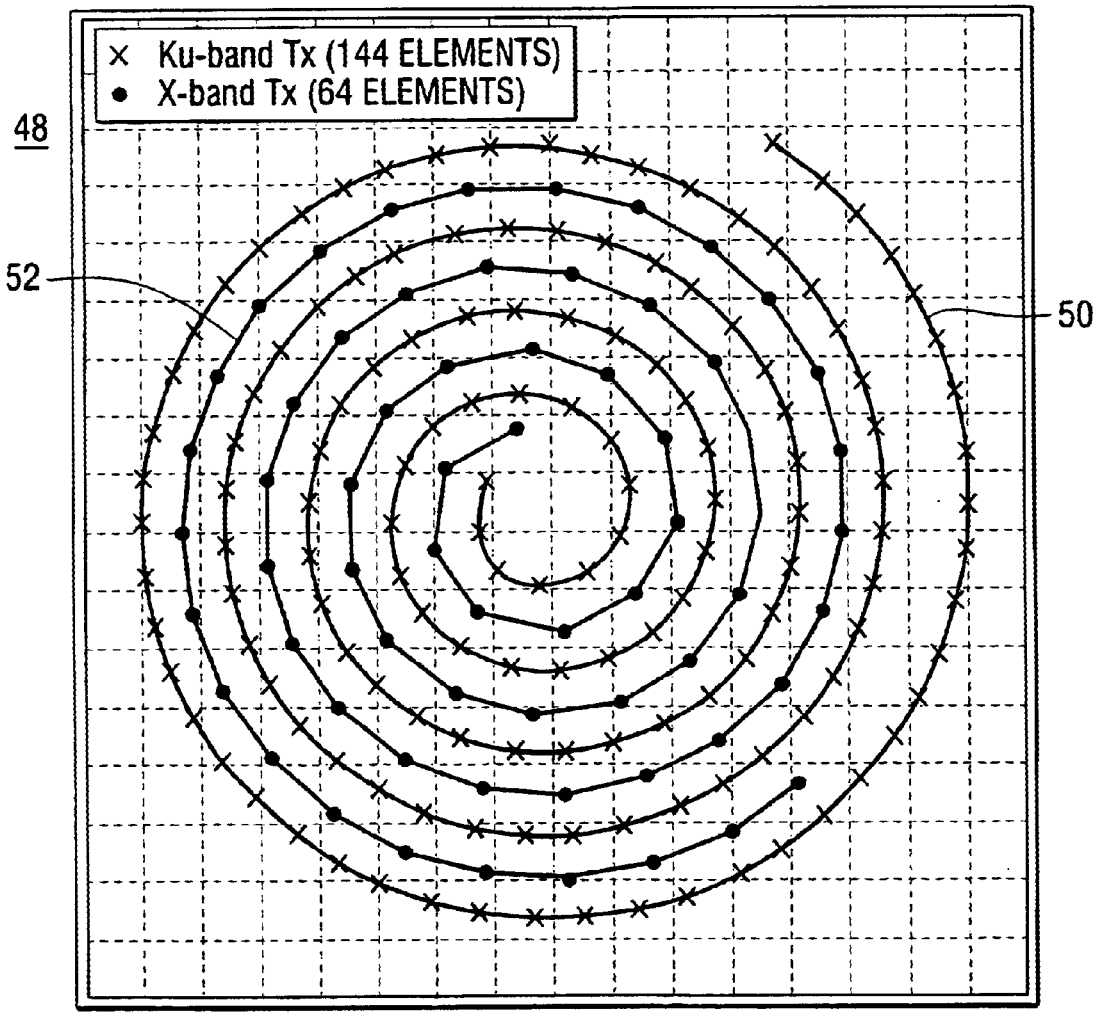

FIG. 7 illustrates a dual Archimedean spiral sub-array 48 comprising nested spirals 50 and 52 for dual band operation of the antenna array. In the embodiment of FIG. 7, the spirals 50 and 52 are illustrated as Archimedean spirals, but this is not necessarily required according to the teachings of the present invention, as any other spiral shapes can be employed. Relative x and y axes spacing between the individual elements of the Archimedean spirals 50 and 52 are also illustrated in FIG. 7 on the x and y axes.

In one embodiment, the spirals 50 and 52 are designed to transmit in two different frequency bands. For example, the spiral 50 can be constructed with about 144 elements and appropriately spaced such that transmission in the Ku band is optimized. With about 64 elements in the spiral 52, transmission in the X band is optimized. Those skilled in the art recognize that the element numbers set forth herein are merely exemplary. The number of elements is influenced by the desired antenna gain in each frequency band. The overall array antenna boresight gain is determined by the sum of the individual element gain plus, n, the number of elements. For example, with an element gain of 8 dB and 100 elements, the overall array antenna gain is about 28 dB.

The greater spacing between elements as provided by the spiral-shaped sub-arrays as taught herein allows this nesting of spirals and thus the formation of multiple beams from a single spiral. Thus each spiral of elements is separately driven to provide the multiple radiation beams.

In the various embodiments set forth, the element spacing can vary from a half wavelength to more than a full wavelength at the operating frequency, given the constraint that the element spacings are established so that the vertical plane passing through the plane of the sub-array intersects a minimum number or elements. It has been demonstrated that even for element spacings in excess of a wavelength, grating lobes are still minimized. As a result, the elements can be spaced farther apart than taught by the prior art, providing more space between elements, and thereby allowing the electronics components operative with each element to be directly integrated into the antenna array.

In each of the embodiments set forth herein, the operating frequency of the antenna array is established by the bandwidth and fundamental operating frequency of the individual elements, the element spacing and the element cell area. Thus these parameters can be varied to produce an antenna operative at the desired frequency and bandwidth.

Figure 8:
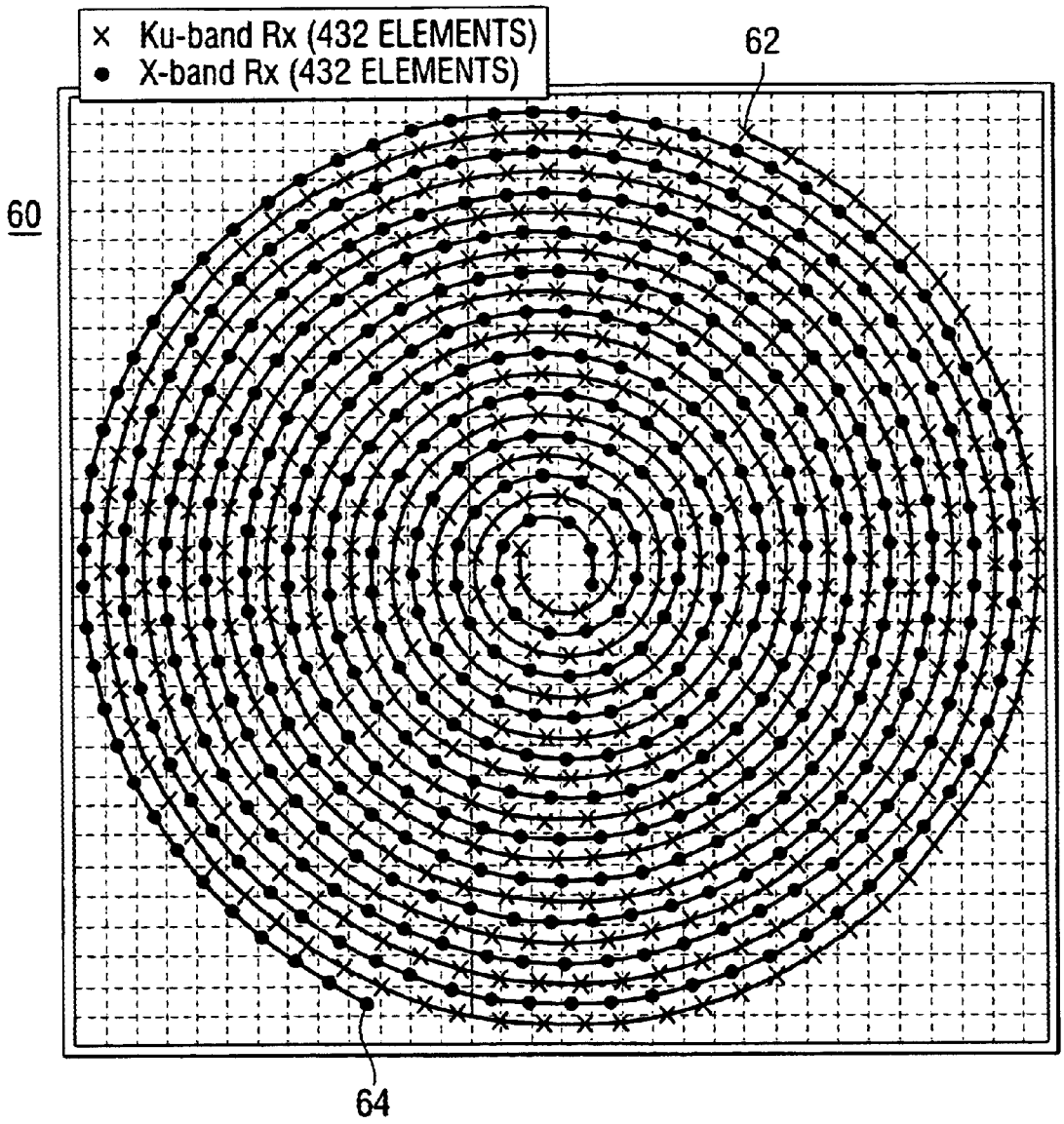

FIG. 8 illustrates a dual Archimedean spiral sub-array 60, comprising nested element spirals 62 and 64. In one embodiment the spiral 62 comprises 432 elements for receiving Ku band signals at a different Ku band frequency than the spiral 50 of FIG. 7. The spiral 64 includes 432 antenna elements for receiving/transmitting signals in the X band, but at a different X-band frequency than the spiral 52 of FIG. 7. The additional elements in the dual Archimedean spiral sub-array 60, as compared with the dual Archimedean spiral sub-array 48, are required in certain applications to enhance the signal receiving capabilities of the antenna array, that is, the antenna gain.

The teachings of the present invention do not require that the spiral sub-arrays 48 and 60 be formed from Archimedean spirals. A log spiral grid, or other spiral shapes, including those described herein, can be used in place of the Archimedean spirals.

Figure 9:
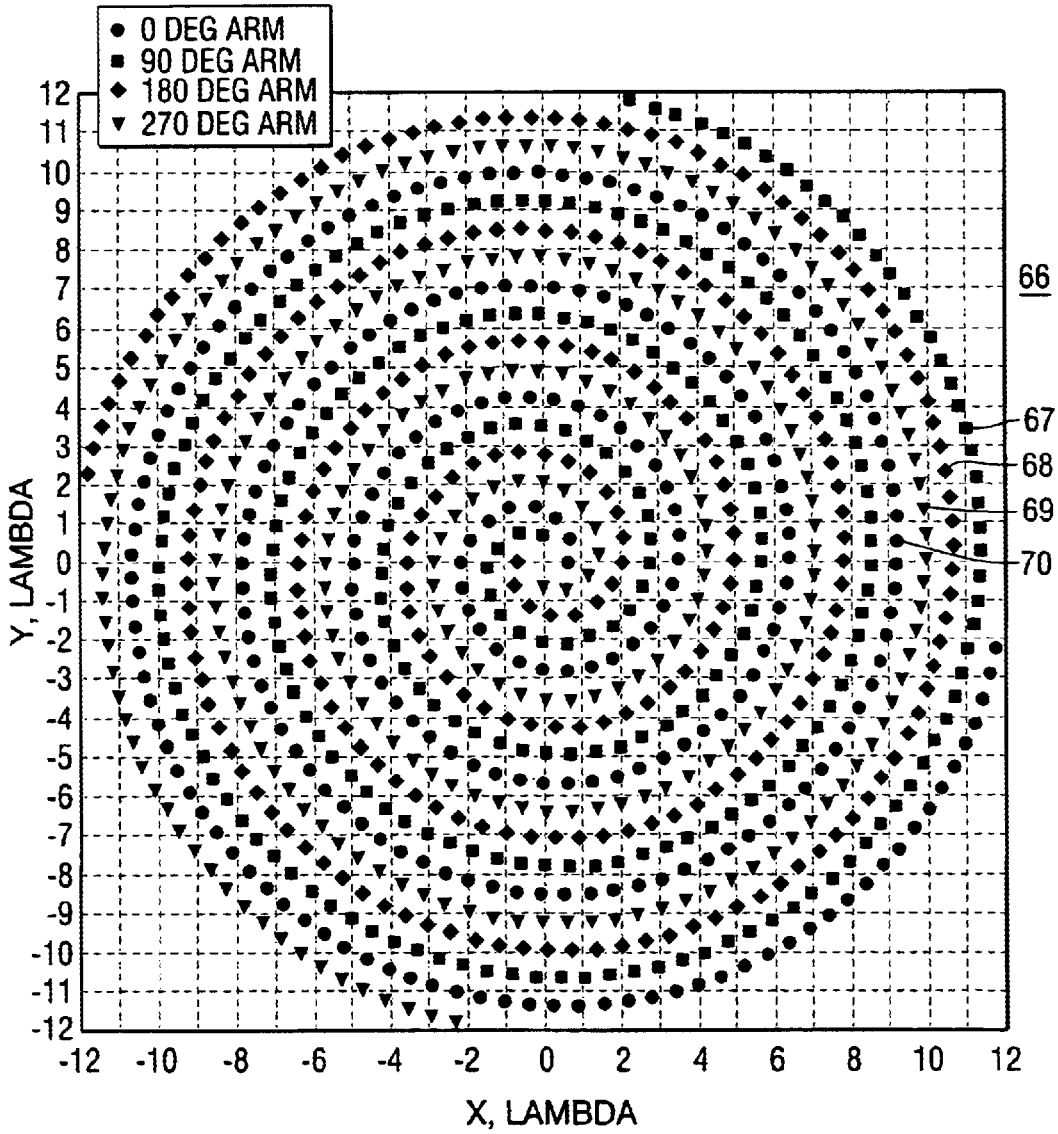

FIG. 9 illustrates a balanced spiral sub-array 66 comprising four element spirals 67, 68, 69 and 70. The starting point for the four spirals 67–70 is at 0°, 90°, 180° and 270°. The two-opposing spirals 67 and 69, and the two opposing spirals 68 and 70 are fed to produce two balanced series-fed element spirals. Thus the four element spirals 67, 68, 69, and 70 of the sub-array 66 form two series fed arrays. In one embodiment the element spirals 67, 68, 69 and 70 comprise Archimedean spirals, although any of the known various spiral shapes can be used in place of the Archimedean spiral.

In another embodiment the four element spiral elements 67–70 can be driven independently to produce four independent beams. As a further embodiment, the four spirals 67–70 can be driven at the same frequency or at four (or fewer) separate frequencies to provide multi-beam same frequency or multi-beam different frequency operation. Further, the four spiral arrays can be driven in any combination to achieve four or fewer lower beam gains or one high gain beam. The gain of each beam is determined proportionally by the number of spirals included to produce the beam. For example, if each spiral has a numeric gain of G, then any combination of two spirals has a total gain 2G. If two spirals are combined to produce a beam with gain 2G, either or both of the two remaining spirals operates with a gain G. Three spirals operate with a gain of 3G while the fourth spiral produces a beam with gain G. Operating all four spirals as a single antenna sub-array yields an antenna gain of 4G. In any of these embodiments each of the nested spirals uses the complete aperture of the sub-array and thus has the directivity associated with the complete aperture. Thus the sub-arrays produce an antenna pattern with equal beamwidths in all planes of the sub-array pattern.

The balanced spiral sub-array 66 can be operated as an array antenna or a plurality of the balanced spiral sub-arrays 66 can be combined to form an array antenna.

Use of the sub-array 66 in the antenna array 20 breaks up the frequency scan grating lobes as follows. For a series fed array of elements operating as a linear array, the series feeding and the constant phase shift between elements produces movement of the antenna beam as a function of frequency, causing mispointing error and a variation in the gain as a function of frequency. The grating lobes produced by this effect are referred to as frequency scan grating lobes. The various spiral grids described herein do not exhibit this effect, when series fed, due to the spiral orientation of the elements.

Figure 10:
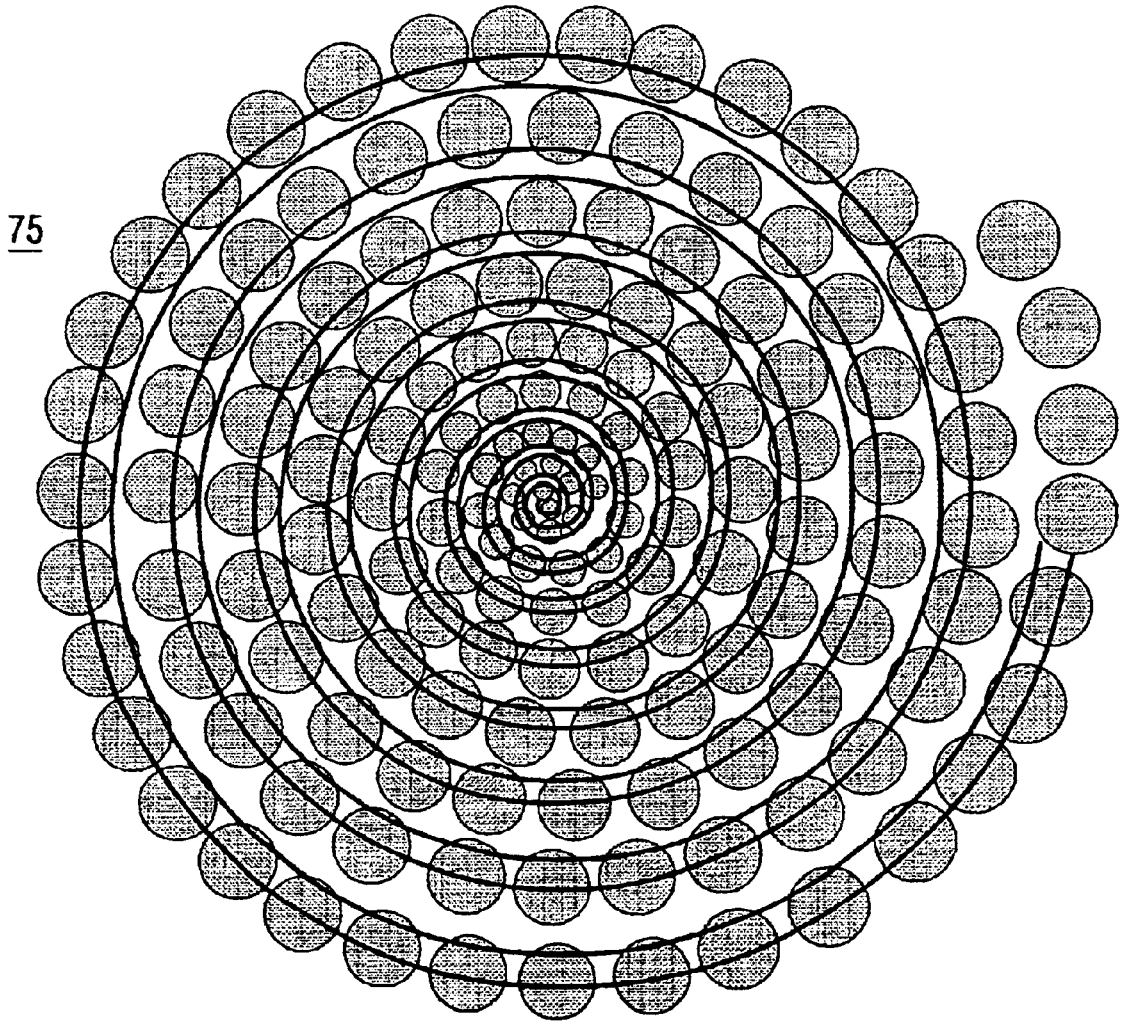

FIG. 10 illustrates yet another sub-array for use in the array antenna 20. The FIG. 10 sub-array is a variable element size log spiral 75. That is, the spiral shape is governed by equation (2) above. Also, as can be seen, the elements near the spiral center are relatively small and the element size grows progressively along the spiral leg. The variable element size log spiral 75 offers a wider bandwidth and aperture taper for a constant aperture size. As the elements grow larger in size, the spacing between elements also increases, thus providing additional space for the various associated electronics components and reducing the number of sub-array elements, as discussed in conjunction with FIG. 2.

FIGS. 11 through 14 illustrate a plurality of exemplary array antennas in which the various spiral antenna element orientations described above can be used as sub-arrays.

Figure 11:
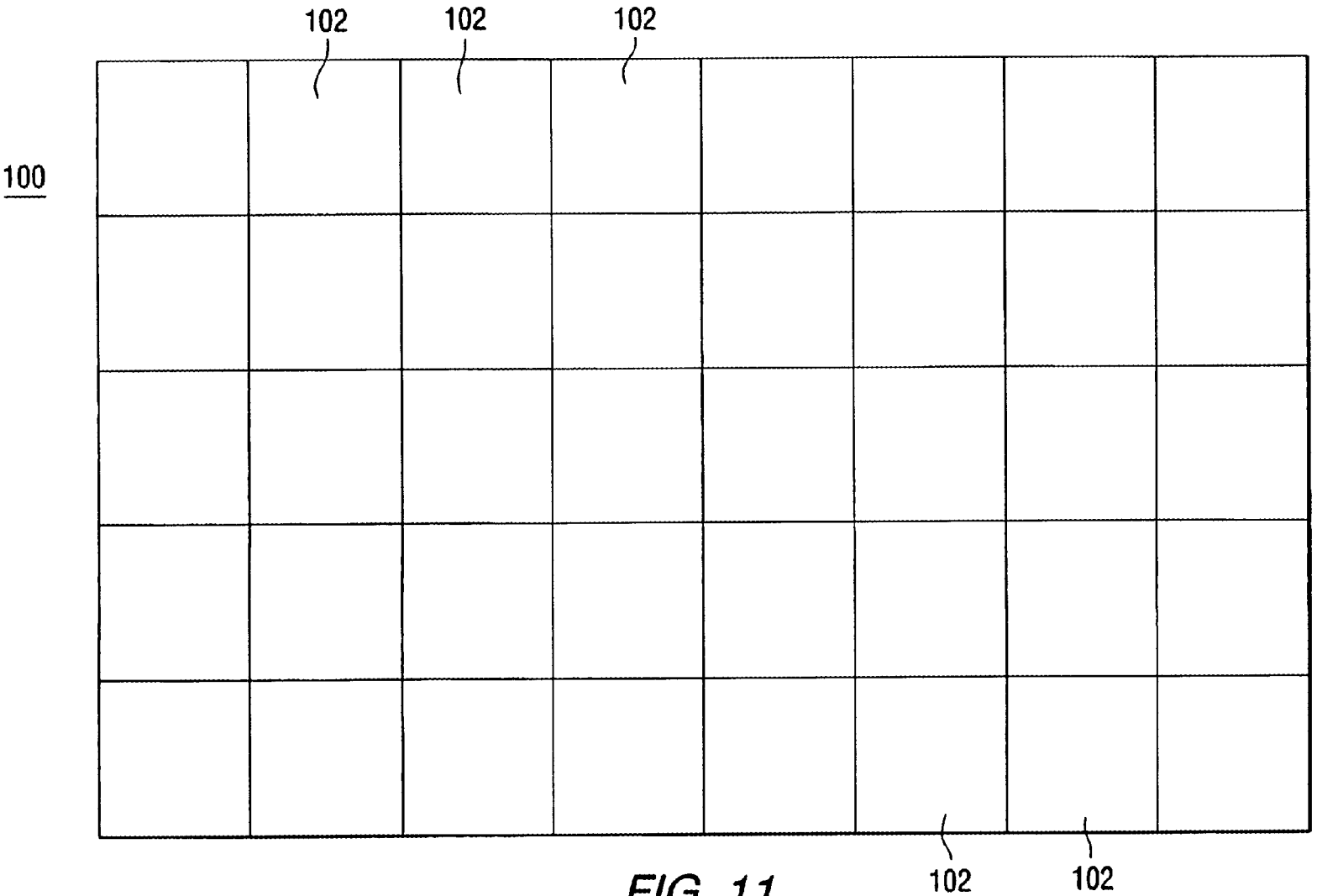
FIGS. 11 through 14 illustrate various array antennas to which the teachings of the present invention can be applied.

FIG. 11 illustrates an array antenna lattice 100 having generally square sub-lattice grids 102. The various spiral shaped sub-array grids described above (including the Archimedean spiral 30, the log spiral 40, the dual spirals 48 and 60, the balanced spiral 68 and the variable element size log spiral 75) can be used in each of the sub-lattice grids 102. In another embodiment, at least two different sub-array grid spirals (for instance, an Archimedean spiral and a log spiral) populate the sub-array lattices 102 to achieve the desired array antenna properties.

Figure 12:
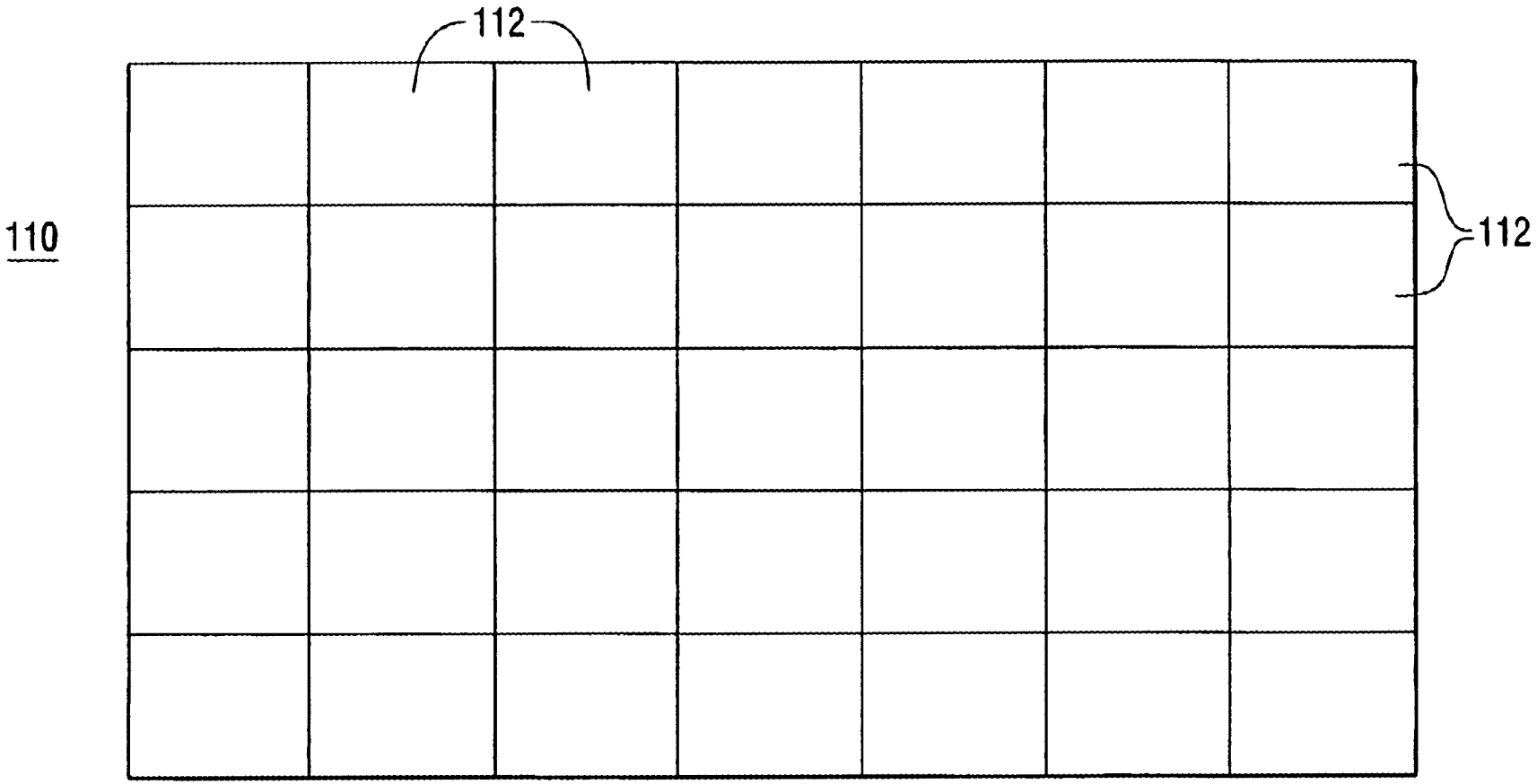

An array lattice 110 of FIG. 12 comprises a plurality of generally rectangular sub-arrays 112. The various spiral-based grids described above can serve as the antenna element configuration within each of the sub-arrays 112.

Figure 13:
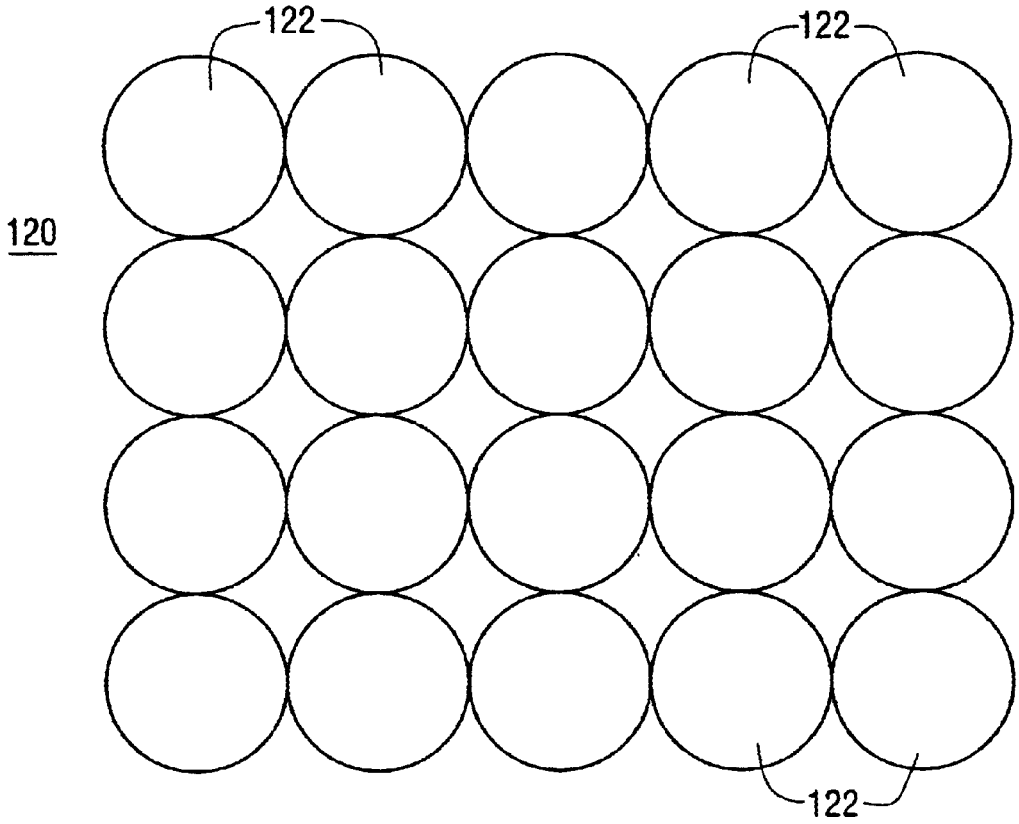
Figure 14:
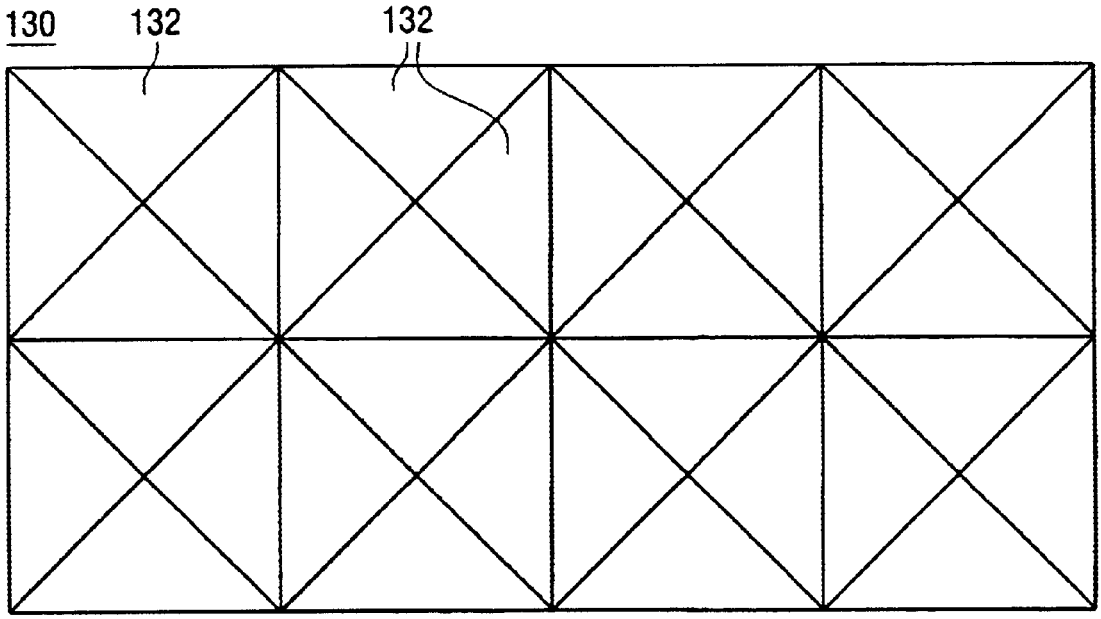

An array antenna lattice 120 comprising a plurality of circular sub-arrays 122, as illustrated in FIG. 13, provides an efficient packing density for the spiral-based sub-arrays described herein, since the boundary of the spiral sub-arrays approximates a circle.

Figure 15:
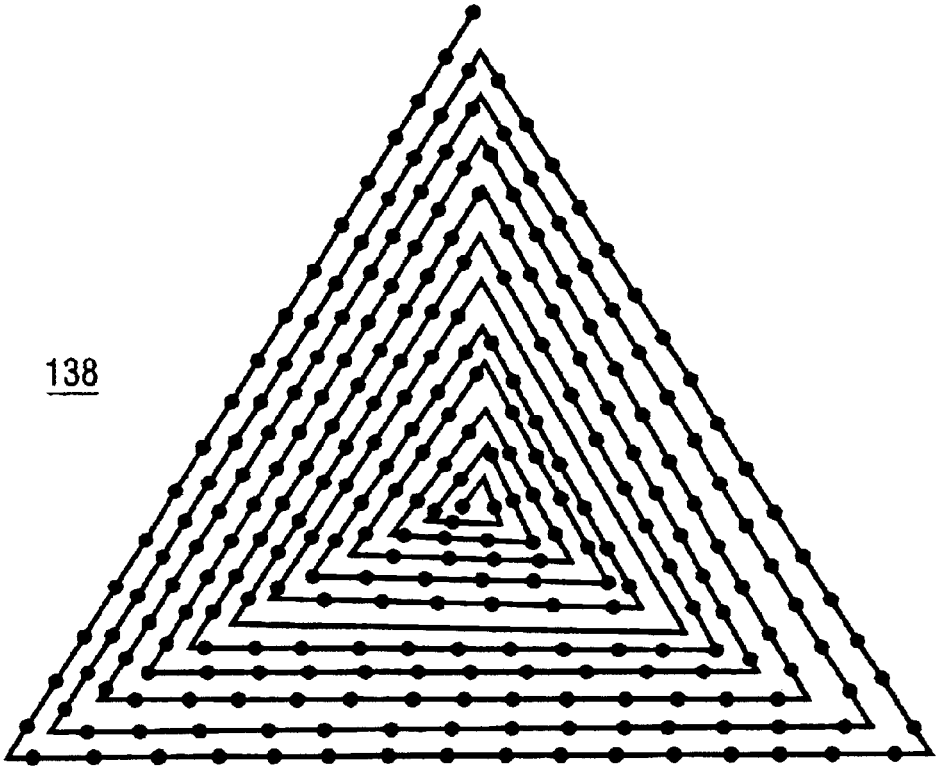
FIG. 15 illustrates a triangular sub-array.

An array antenna lattice 130 (see FIG. 14) comprises a plurality of adjacent triangular sub-arrays 132. For this embodiment, especially efficient packing of the antenna elements and the sub-arrays 132 is provided by triangular spiral sub-arrays 138 such as illustrated in FIG. 15. The individual antenna elements are spaced along the triangular spiral sub-arrays 138 in a manner similar to their spacing in the spiral sub-arrays described above. It has been determined that the radiation pattern sidelobes of an antenna array constructed of the triangular spirals 138, are similar to the side lobes formed when the spirals described above are used in the antenna array. Also, 100% aperture efficiency can be achieved with equilateral triangle sub-arrays populated with equilateral triangular spirals, since with this configuration antenna elements can be placed throughout the entire array lattice 130.

Figure 16:
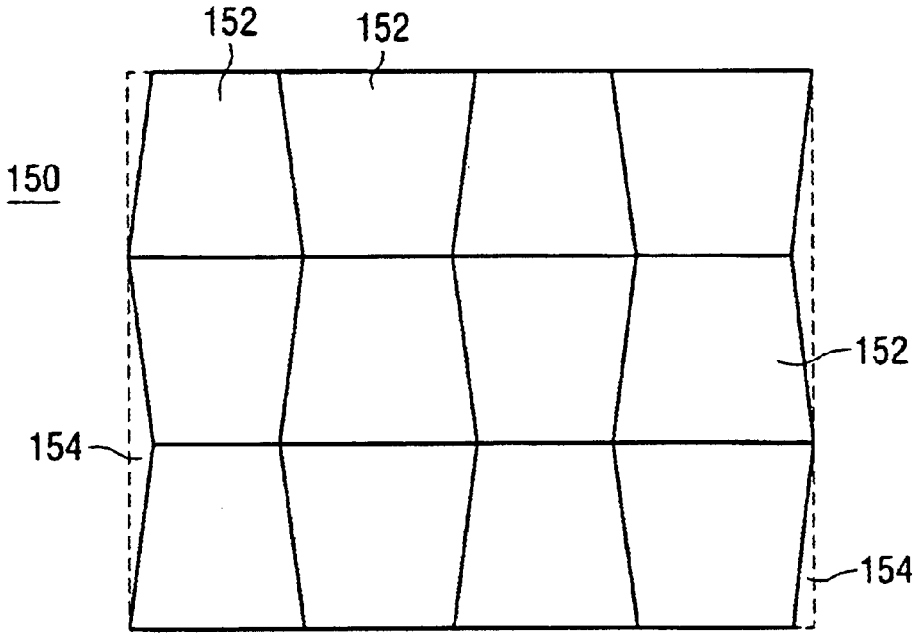
FIG. 16 illustrates a polygonal array antenna.

FIG. 16 illustrates a polygonal array antenna lattice 150 comprising a plurality of polygons 152.

Figure 17A:
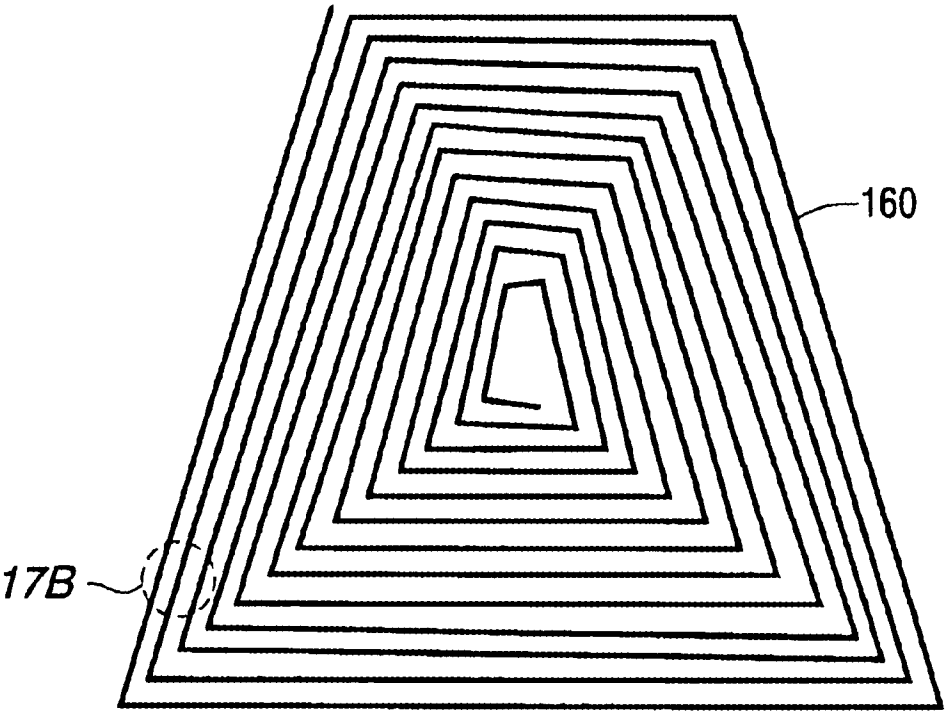
FIGS. 17A and 17B illustrate a polygonal sub-array constructed according to the teachings of the present invention and a pyramidal array antenna comprised thereof.

A sub-array 160 illustrated in FIG. 17A comprises a plurality of antenna elements arranged in a polygonal spiral. Thus the polygonal sub-array 160 tessellates efficiently into the polygonal array lattice 150 of FIG. 16. Nearly 100% aperture efficiency can be achieved. Only areas 154 as shown in FIG. 16 are void of antenna elements.

Figure 17B:
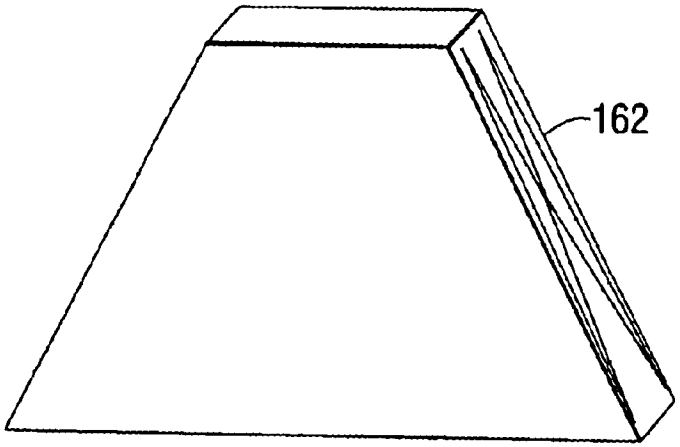

A plurality of sub-arrays 160 of FIG. 17A can be formed into a pyramidal shape array antenna 162, as illustrated in FIG. 17B, for providing hemispherical coverage.

Figure 18:
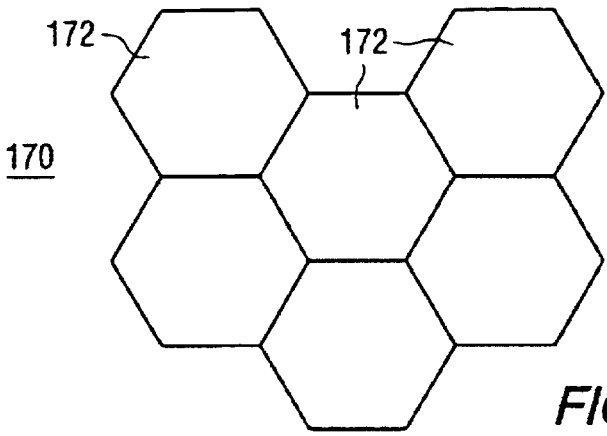
FIG. 18 illustrates a hexagonal array antenna.

FIG. 18 illustrates a hexagonal array lattice 170 comprising a plurality of hexagonal sub-arrays 172. Any of the various spiral element configurations and sub-arrays described above can be utilized as the antenna element configuration within the hexagonal sub-arrays 172. Preferably the hexagonal sub-array 172 comprises a hexagonal shaped spiral of antenna elements.

Figure 19:
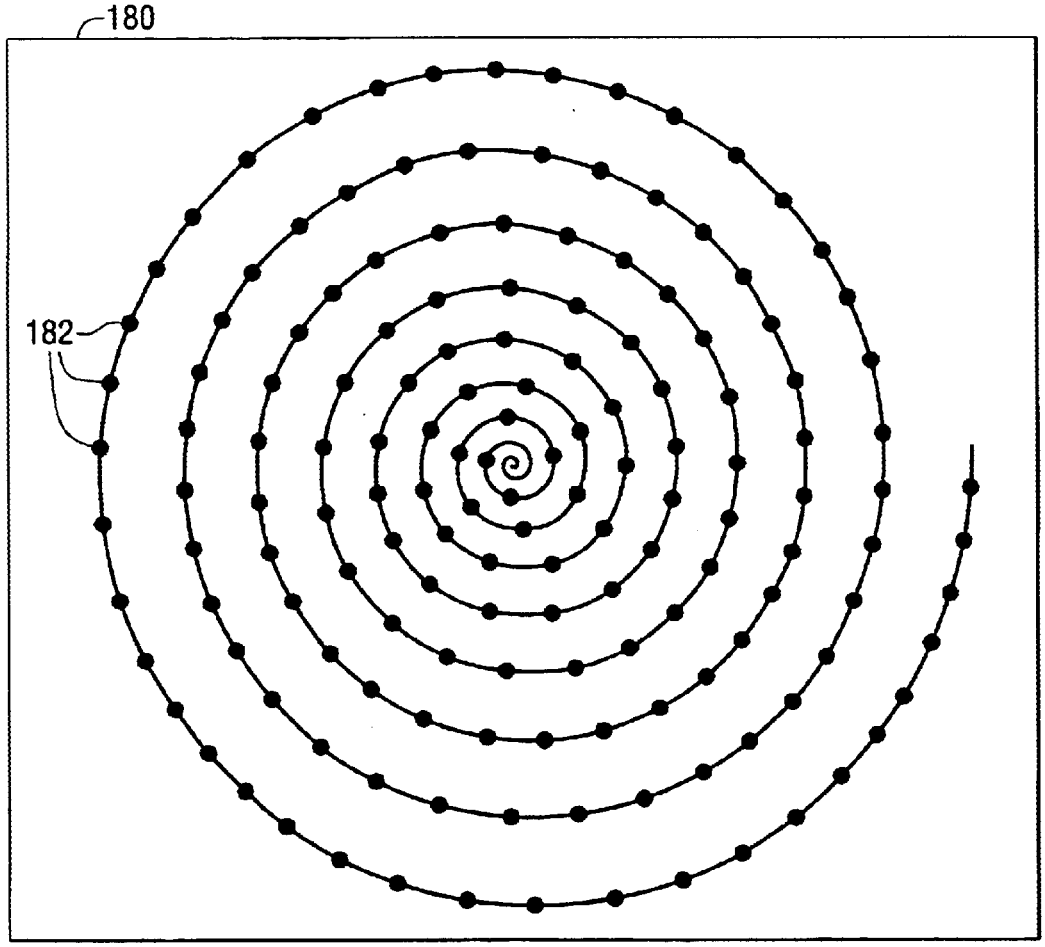
FIG. 19 illustrates an array antenna constructed according to the teachings of the present invention.

Although the present invention has been described as applied to sub-arrays of an array antenna, the teachings with respect to element placement can also be applied to the elements of an array antenna, i.e., an array antenna constructed from individual elements, without discrete sub-arrays. For such an array antenna the elements can be positioned in a spiral configuration such that a minimum number of elements intersect planes perpendicular to the array plane and passing through the spiral center. Thus an array antenna 180 is illustrated in FIG. 19, where the antenna elements 182 are positioned according to a log spiral configuration.

Many modifications and other embodiments of the invention will come to the mind of one skilled in the art having the benefit of the teachings presented in the foregoing descriptions and the associated drawings. Therefore, it is to be understood that the invention is not to be limited to the specific embodiments disclosed, and that the modifications and embodiments are intended to be included within the scope of the claims.

That which is claimed is:

1. An array antenna comprising:

a plurality of sub-arrays each one of the plurality of sub-arrays further comprising antenna elements; and wherein the antenna elements of each of the plurality of sub-arrays are configured in a spiral orientation with respect to a center of the sub-array.

2. The array antenna of claim 1 wherein the plurality of sub-arrays are arranged in an aperiodic pattern with respect to each other to form the array antenna.

3. The array antenna of claim 1 wherein the plurality of sub-arrays are arranged in a periodic pattern with respect to each other to form the array antenna.

4. The array antenna of claim 1 wherein the antenna elements of each of the plurality of sub-arrays are spaced from each other a distance substantially greater than one-half wavelength of a transmitted or a received signal.

5. The array antenna of claim 1 wherein the spiral orientation is selected from among an Archimedean spiral and a log spiral.

6. The array antenna of claim 1 wherein the spiral comprises an elongated curve originating at a center of the sub-array and extending therefrom along a continuous path.

7. The array antenna of claim 6 wherein the path comprises a plurality of arcuate segments, and wherein the distance between adjacent arcuate segments increases with distance from the center of the sub-array.

8. The array antenna of claim 6 wherein the path comprises a plurality of arcuate segments, and wherein the distance between adjacent arcuate segments decreases with distance from the center of the sub-array.

9. The array antenna of claim 1 wherein the distance between adjacent antenna elements within each one of the plurality of sub-arrays increases with distance from the center of the sub-array.

10. The array antenna of claim 1 wherein the distance between adjacent antenna elements within each one of the plurality of sub-arrays decreases with distance from the center of the sub-array.

11. The array antenna of claim 1 wherein the distance between adjacent antenna elements of each one of the plurality of sub-arrays is aperiodic.

12. The array antenna of claim 1 wherein the antenna elements are equally spaced with distance from the center of the sub-array.

13. The array antenna of claim 1 wherein an antenna element cell size increases with distance from the center of the sub-array.

14. The array antenna of claim 1 wherein an antenna element cell size decreases with distance from the center of the sub-array.

15. The array antenna of claim 1 wherein an antenna element size increases with distance from the center of the sub-array.

16. The array antenna of claim 1 wherein an antenna element size decreases with distance from the center of the sub-array.

17. The array antenna of claim 1 wherein the configuration of the antenna elements within each one of the plurality of sub-arrays is substantially identical.

18. The array antenna of claim 1 wherein each one of the plurality of sub-arrays is substantially identical.

19. The array antenna of claim 1 wherein the peripheral boundary of each one of the plurality of sub-arrays is selected such that the plurality of sub-arrays are tessellated to form the array antenna.

20. The array antenna of claim 19 wherein the peripheral boundary is selected from among a triangle, an equilateral triangle, a polygon, a rectangle, a square, a hexagon and a circle.

21. The array antenna of claim 19 wherein the spiral orientation of the antenna elements of each one of the plurality of sub-arrays is determined by the peripheral boundary of the sub-array, such that the antenna elements fit efficiently within a region defined by the peripheral boundary.

22. The array antenna of claim 19 wherein the spiral configuration is defined by a line along which the antenna elements are located, and wherein the line has a shape substantially similar to the peripheral boundary of the sub-array.

23. The array antenna of claim 1 wherein the antenna elements of each one of the plurality of sub-arrays are configured in a first orientation in a first region of the sub-array and in a second orientation in a second region of the sub-array.

24. The array antenna of claim 1 wherein the spiral begins at a center of the sub-array and follows a first arcuate path from the center point to a transition point and transitions to a second arcuate path at the transition point.

25. The array antenna of claim 1 wherein the configuration of the antenna elements in the spiral orientation in each one of the plurality of sub-arrays comprises positioning the antenna elements to minimize the number of antenna elements that are intersected by imaginary planes perpendicular to the plane of the sub-array, wherein the imaginary planes pass through the spiral center.

26. The array antenna of claim 1 wherein the antenna elements of each one of the plurality of sub-arrays comprise the same antenna type.

27. The array antenna of claim 1 wherein the antenna elements of each one of the plurality of sub-arrays comprise the different antenna types.

28. The array antenna of claim 1 wherein the antenna elements of a first one of the plurality of sub-arrays comprise a first antenna type, and wherein antenna elements of a second one of the plurality of sub-arrays comprise a second antenna type.

29. The array antenna of claim 1 further comprising a dielectric substrate wherein the antenna elements comprise conductive material formed thereon.

30. The array antenna of claim 1 wherein one or more of the plurality of sub-arrays comprises a first group of antenna elements configured in a first spiral orientation nested among a second group of antenna elements configured in a second spiral orientation, and wherein the first group of antenna elements are selected to provide a first radiation beam pattern, and wherein the second group of antenna elements are selected to provide a second radiation beam pattern.

31. An array antenna providing a plurality of radiation beam patterns, comprising:

a plurality of sub-arrays; and wherein the each one of the plurality of sub-arrays comprises a first group of antenna elements configured in a first spiral orientation nested among a second group of antenna elements configured in a second spiral orientation, and wherein the first group of antenna elements are selected to provide a first radiation beam pattern and wherein the second group of antenna elements are selected to provide a second radiation beam pattern.

32. The array antenna of claim 31 wherein the first group of antenna elements are driven separately from the second group of antenna elements.

33. The array antenna of claim 31 wherein the first group of antenna elements are serially connected to the second group of antenna elements.

34. The array antenna of claim 31 wherein the configuration of the antenna elements in the first and the second spiral orientations comprises positioning the antenna elements to minimize the number of antenna elements that are intersected by imaginary planes perpendicular to the plane of the sub-array, and wherein the imaginary planes pass through the spiral center.

35. A multiple-band array antenna comprising:

a plurality of sub-arrays;

wherein a first plurality of antenna elements of each sub-array are configured in a first spiral orientation; and wherein a second plurality of antenna elements of each sub-array are configured in a second spiral orientation nested within the first spiral orientation, and wherein the first plurality of antenna elements are configured to operate at a first frequency, and wherein the second plurality of antenna elements are configured to operate at a second frequency.

36. The multiple-band array antenna of claim 35 wherein the orientation of each one of the plurality of sub-arrays with respect to each other is selected from among a periodic and an aperiodic orientation.

37. The multiple-band array antenna of claim 35 wherein the configuration of the first and the second plurality of antenna elements in the first and the second spiral orientations, respectively, comprises positioning each of the first and the second plurality of antenna elements to minimize the number of antenna elements that are intersected by imaginary planes perpendicular to the plane of the sub-array and passing through the spiral center point.

38. A phased array antenna comprising:

a plurality of sub-arrays each comprising a plurality of antenna elements; and wherein the antenna elements of each one of the plurality of sub-arrays are configured in a spiral orientation, and wherein the spiral orientation comprises positioning the antenna elements to minimize the number of antenna elements that are intersected by imaginary planes perpendicular to the plane of the sub-array and passing through the spiral center.

39. An antenna, comprising:

a plurality of antenna elements arranged in a spiral orientation; and wherein the spiral orientation comprises positioning the plurality of antenna elements to minimize the number of antenna elements that are intersected by imaginary planes perpendicular to the plane of the antenna and passing through the spiral center.

40. An antenna comprising:

a plurality of sub-arrays each comprising a plurality of antenna elements configured in a spiral orientation, wherein the spiral orientation comprises positioning the plurality of antenna elements to minimize the number of antenna elements that are intersected by imaginary planes perpendicular to the plane of the antenna and passing through the spiral center point; and wherein the plurality of sub-arrays are arranged in a three-dimensional configuration.

41. A method for orienting a plurality of antenna elements to reduce grating lobes in the radiation pattern of the plurality of antenna elements, comprising:

arranging the plurality of elements in a spiral configuration;

passing a plurality of imaginary planes perpendicular to the plane of the spiral and passing through the spiral center; and minimizing the number of the plurality of elements intersecting each one of the plurality of imaginary planes.

* * * * *